US005400584A

United States Patent [19]

Ito et al.

[11] Patent Number: 5,400,584

[45] Date of Patent: Mar. 28, 1995

[54] CABLE MANUFACTURING METHOD

[75] Inventors: Kenji Ito; Kouki Kusakai, both of Ibaraki, Japan

[73] Assignee: Tokyo Roe Mfg. Co., Ltd., Tokyo, Japan

[21] Appl. No.: 128,845

[22] Filed: Sep. 29, 1993

[51] Int. Cl.[6] ..... H01B 13/02

[52] U.S. Cl. ..... 57/314; 57/3; 57/13; 57/63; 57/66; 57/352; 57/361

[58] Field of Search ..... 57/3, 314, 66, 59, 62, 57/63, 64, 12, 13, 14, 15, 352, 361

[56] References Cited

U.S. PATENT DOCUMENTS

| | | | |
|---|---|---|---|
| 3,187,495 | 6/1965 | Christian | 57/314 X |
| 3,526,570 | 9/1970 | Durkee et al. | 57/314 |
| 3,572,024 | 3/1971 | Lyon | 57/314 X |
| 4,151,704 | 5/1979 | Spicer et al. | 57/13 |
| 4,426,838 | 1/1984 | Garner | 57/13 X |
| 4,813,223 | 3/1989 | Nipper et al. | 57/13 X |
| 4,974,408 | 12/1990 | Karhu | 57/314 X |
| 5,226,271 | 7/1993 | Karhu | 57/352 X |
| 5,307,617 | 5/1994 | Karhu | 57/352 X |

FOREIGN PATENT DOCUMENTS

| | | | |
|---|---|---|---|
| 1023805 | 2/1958 | Germany | 57/65 |
| 52-5356 | 1/1977 | Japan . | |
| 3-60954 | 9/1991 | Japan . | |
| 2219063 | 11/1989 | United Kingdom | 57/314 |

OTHER PUBLICATIONS

Patent Abstracts Of Japan, vol. 15, No. 478 (C-891), Dec. 4, 1991 & JP-A-03 206 194 (Tokyo Seiko Co., Ltd.) Sep. 9, 1991.

*Primary Examiner*—Daniel P. Stodola
*Assistant Examiner*—William Stryjewski
*Attorney, Agent, or Firm*—Frishauf, Holtz, Goodman & Woodward

[57] ABSTRACT

A cable manufacturing method comprising the steps of arranging a closing die and a plurality of panel plates in this order, on a pass-line having a curved zone and a linear zone, from the side of a front end of the pass-line, inserting all wires, to be stranded, through an opening of the closing die, and inserting each wire through a hole formed in a corresponding one of the panel plates, guiding the wires such that the wires are substantially parallel with one another and each wire is loose of the panel plates, rotatably supporting the panel plates, respectively, and passing each wire through the curved zone and the linear zone while rotating the panel plates in the same direction, thereby stranding the wires with a large pitch so as not to plastically deform the wires.

15 Claims, 10 Drawing Sheets

CABLE MANUFACTURING METHOD

BACKGROUND OF THE INVENTION

1. Field of the Invention

This invention relates to a method for manufacturing a cable used as a stay in a cable-stayed bridge.

2. Description of the Related Art

In general, a Parallel Wire Strand cable (PWS) is used as a stay in a cable-stayed bridge. The PWS consists of a bundle of plural wires arranged parallel with one another, and has a high breaking-load strength and a high elastic coefficient. Thus, the PWS has superior properties for use as a stay in a cable-stayed bridge.

Such a PWS is carried from a manufacturing plant to a bridge-construction site, wound on a reel. It is difficult to wind the PWS onto a reel neatly and a substantial amount of time and labor are required to do so, since the bundled parallel wires of the PWS can easily deform.

To overcome the disadvantages, the development of a cable which has a rope structure in which the wires are stranded has been considered. In this case, however, each of the wires may be deformed plastically, since it is stranded about its axis, causing the so-called "reduction in breaking strength due to stranding" (i.e. reduction in strength resulting from multiplying a linear wire strength by a spining factor). This breaking strength reduction decreases the breaking-load strength and elastic coefficient of the cable, making it difficult to maintain the best properties of a cable to be used as a stay in a cable-stayed bridge.

In view of the above-described circumstances, a method for manufacturing a cable suitable for a cable-stayed bridge has been developed (see Jpn. Pat. Appln. KOKAI Publication No. 3-60954). The cable obtained by the use of this method has substantially the same breaking-load strength and elastic coefficient as a PWS, and can be wound on a reel without causing great deformation of the cross section due to stranding.

Recently, large cable-stayed bridges, such as channel bridges, have been constructed; and accordingly a cable of as long as 300–500 m has been required. In producing such a long cable, closing dies and panel plates must be located in a linear pass-line with the approximate same length as that of the cable. This means that a facility as long as the cable must be built on the manufacturing plant site. In reality, however, it is difficult to construct such a long facility on the site.

SUMMARY OF THE INVENTION

It is the object of the invention to provide a method for manufacturing a long cable without plastically deforming (distortion) the wires of the cable, in a facility shorter than the cable to be manufactured.

According to the invention, there is provided a cable manufacturing method comprising the steps of, arranging a closing die and a plurality of panel plates in this order, on a pass-line having a curved zone and a linear zone, from the side of a front end of the pass-line; inserting all wires, to be stranded, through an opening of the closing die, and inserting each wire through a hole formed in a corresponding one of the panel plates; guiding the wires such that the wires are substantially parallel with one another and each wire is loose of the panel plates; rotatably supporting the panel plates, respectively; and passing each wire through the curved zone and the linear zone while rotating the panel plates in the same direction, thereby stranding the wires with a large pitch so as not to plastically deform the wires.

Since in the above method, the pass-line has a curved zone P3, a cable can be manufactured in a space having a length shorter than the cable to be obtained.

It is preferable to set the radius R of the curved zone P3 of the pass-line PL to a value 100 times or more the diameter d of each wire. This is because if $R<100d$, the wire may be plastically curved (bended) while it passes the curved zone P3.

It is further preferable to provide the wire feed mechanism in the vicinity of the closing die, and to feed each wire from the side of the closing die to the side of the panel plates by the use of the feed mechanism. As a result, many wires can be easily set on the pass-line.

It is also preferable to provide a rotary closing die between the closing die and the panel plate closest thereto, and to rotate the rotary die in the same direction as the panel plates, and fixing the closing die so as not to rotate. In this case, it is desirable to rotate the rotary closing die at half of the rotational speed of the panel plates.

Moreover, a first guide pipe is interposed between each adjacent two panel plates, a plurality of relay pipes are attached to each panel plate in the curved zone, one end of a second guide pipe is coupled with a small-diameter portion of each relay pipe, and the other end of the second guide pipe is inserted into a large-diameter portion of the relay pipe, thereby enabling the wires to be guided through the first and second guide pipes and the relay pipes. By virtue of this structure, the rotation of the panel plates is not interfered by the guide pipes and is performed smoothly. In addition, since each wire passes the pass-line while it is guided by a corresponding guide pipe, the wire is prevented from slacking or contacting adjacent wires. Thus, there is no possibility of tangling of wires, resulting in smooth wire feeding.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiments of the invention will now be explained with reference to the accompanying drawings.

Figure 1:
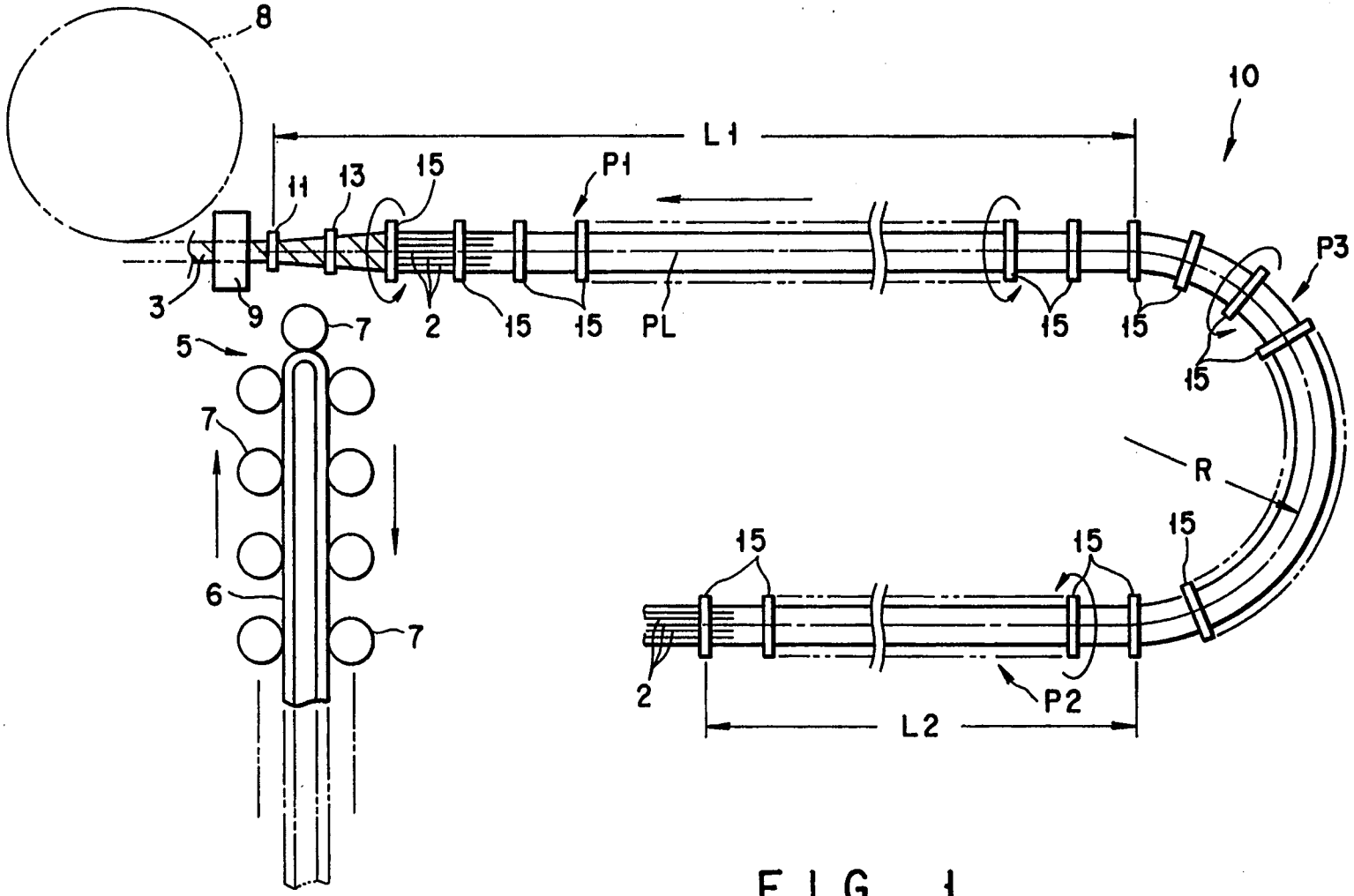
FIG. 1 is a schematic plan view, showing the overall cable manufacturing apparatus which executes a manufacturing method according to a first embodiment of present invention.

As is shown in FIG. 1, a cable manufacturing apparatus comprises a wire feed mechanism 5 and a wire stranding mechanism 10. The wire feed mechanism 5 is provided in the vicinity of a first closing die 11 of the wire stranding mechanism 10, and has a plurality of wire holders 7 on an endless track 6.

Figure 9:
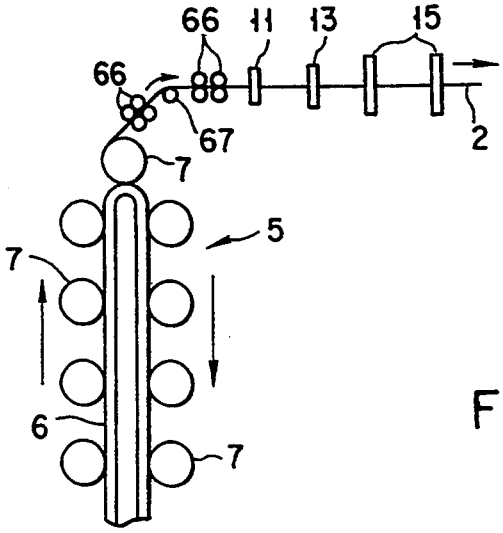
FIG. 9 is a plan view of a wire feeding mechanism, showing a state in which a wire is set on the pass-line of a stranding mechanism by means of the wire feeding mechanism.

As is shown in FIG. 9, the wire feed mechanism 5 has pairs of pinch rolls 66 and guide rolls 67, and is disposed to set a wire 2 on a pass-line PL from the side of the first closing die 11 to the side of panel plates 15. In the wire stranding mechanism 10, a plurality of wires 2 are fed on the pass-line PL, and stranded by means of closing dies 11 and 13 to produce a cable 3 as a stay in a cable-stayed bridge. The wire stranding mechanism 10 can strand approximate five hundreds wires 2 at maximum. The produced cable 3 is wound on a reel 8.

The pass-line PL of the wire stranding mechanism 10 has linear zones P1 and P2 and a curved zone P3. The linear zones P1 and P2 are parallel with each other, and spaced 12 m. The linear zone P1 has a length L1 of about 260 m, and the linear zone P2 a length L2 of about 221 m. The curved zone P3 is a semi-circular line with a radius of 6 m, and one ,end of the curved zone P3 connects the linear zone P1, and other end of the curved zone P3 connects the linear zone P2. The linear zone P1 has the first and second closing dies 11 and 13 and a plurality of panel plates 15, and the linear and curved zones P2 and P3 have a plurality of panel plates 15. The pitch of the panel plates 15 is 2–5 m in the linear zones P1 and P2, and about 1.2 m (i.e., an angle between each adjacent pair of the panel plates 15 is about 11.25°) in the curved zone P3. The wires 2 are inserted from the side of the linear zone P1, and pulled out the side of the linear zone P1.

It is desirable to set a radius R of the curved zone P3 to a value 100 times or more higher than the diameter d of the wire 2, and to set the lengths L1 and L2 to 150–300 m and 150–250 m, respectively. In this embodiment, the lengths L1 and L2 are set to 260 m and 221 m, respectively, and the diameter R 6 m. By the use of this apparatus, 421 wires with a diameter of 7 mm are stranded into a cable with a length of about 400 m.

Figure 2:
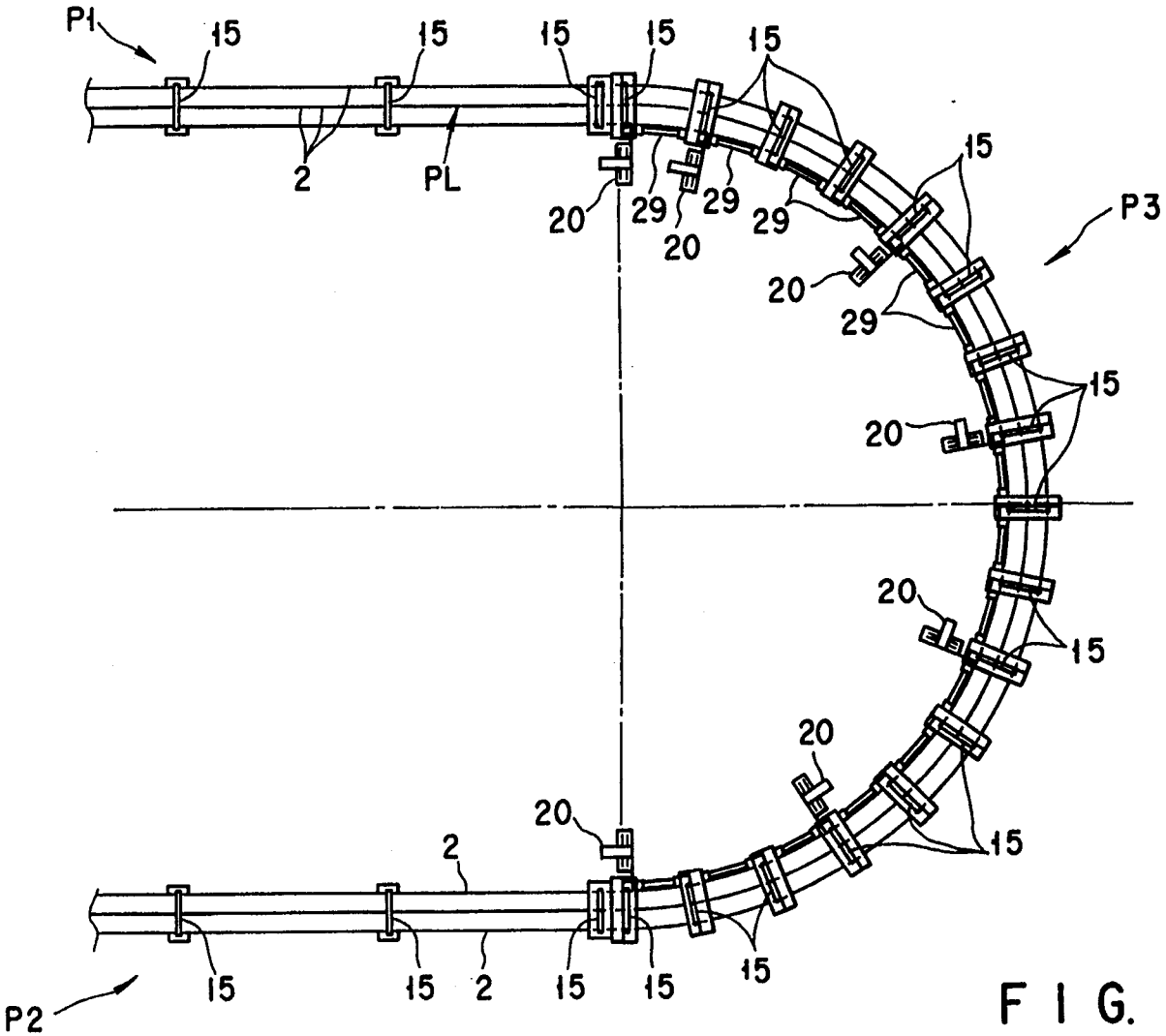
FIG. 2 is a plan view, showing a curved zone of a pass-line.

Then, the curved zone P3 will be explained with reference to FIGS. 2–4.

The curved zone P3 has seventeen panel plates 15 arranged in regular intervals. The distance between each adjacent pair of the plates 15 in the curved zone P3 is shorter than that in the linear zone P1 or P2. Each panel plate 15 is rotatably housed in a bearing case 30. Rotary mechanisms 20 are provided at the inlet and outlet side panel plates 15 and every third panel plates 15. These plates 15 are coupled to one another by means of universal joints 29. Thus, when one of the plates 15 is rotated by a corresponding one of the rotary mechanisms 20, the torque is transmitted to the other plates 15 successively.

Figure 3:
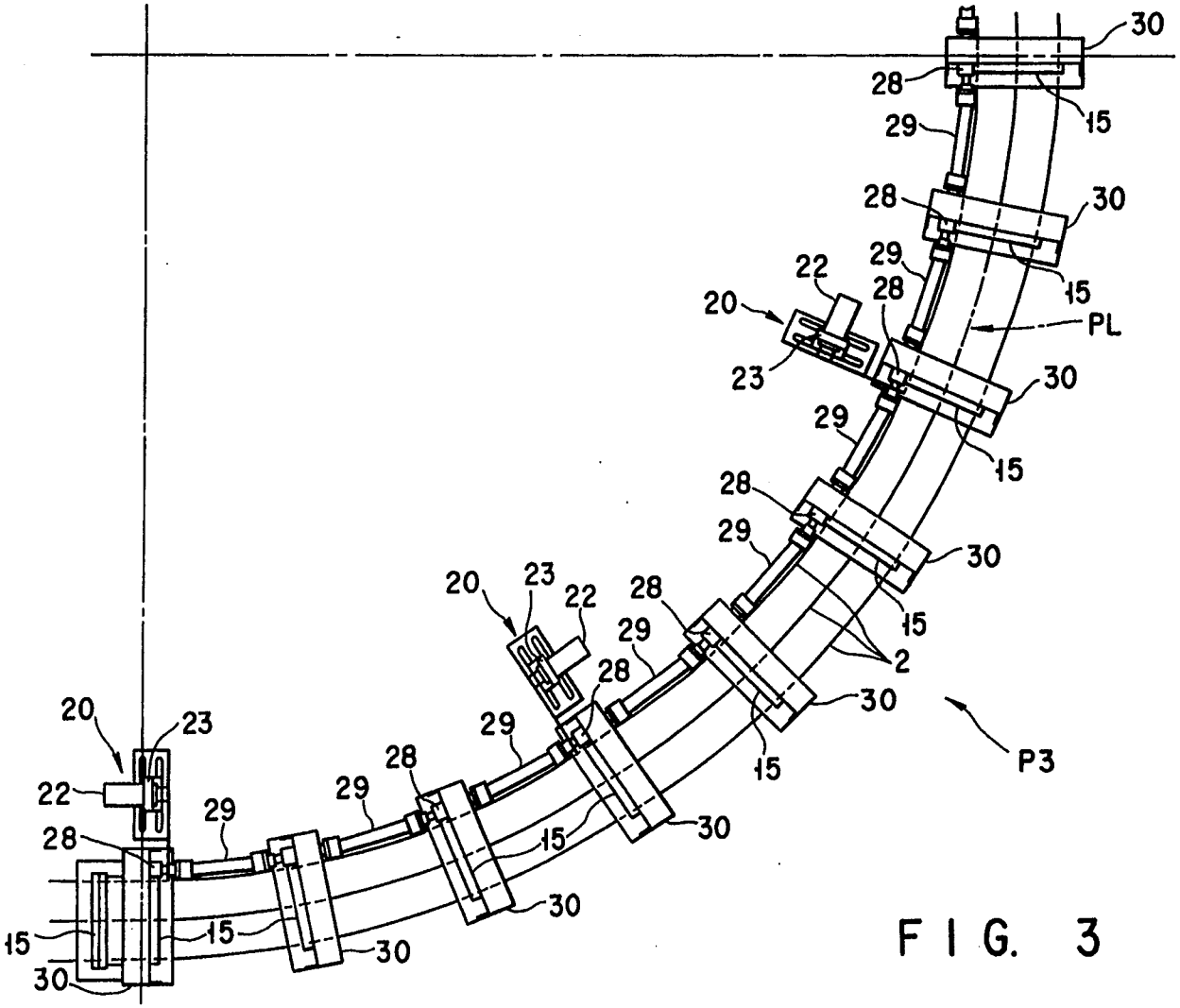
FIG. 3 is an enlarged plan view, showing part of the curved zone of the pass-line.
Figure 4:
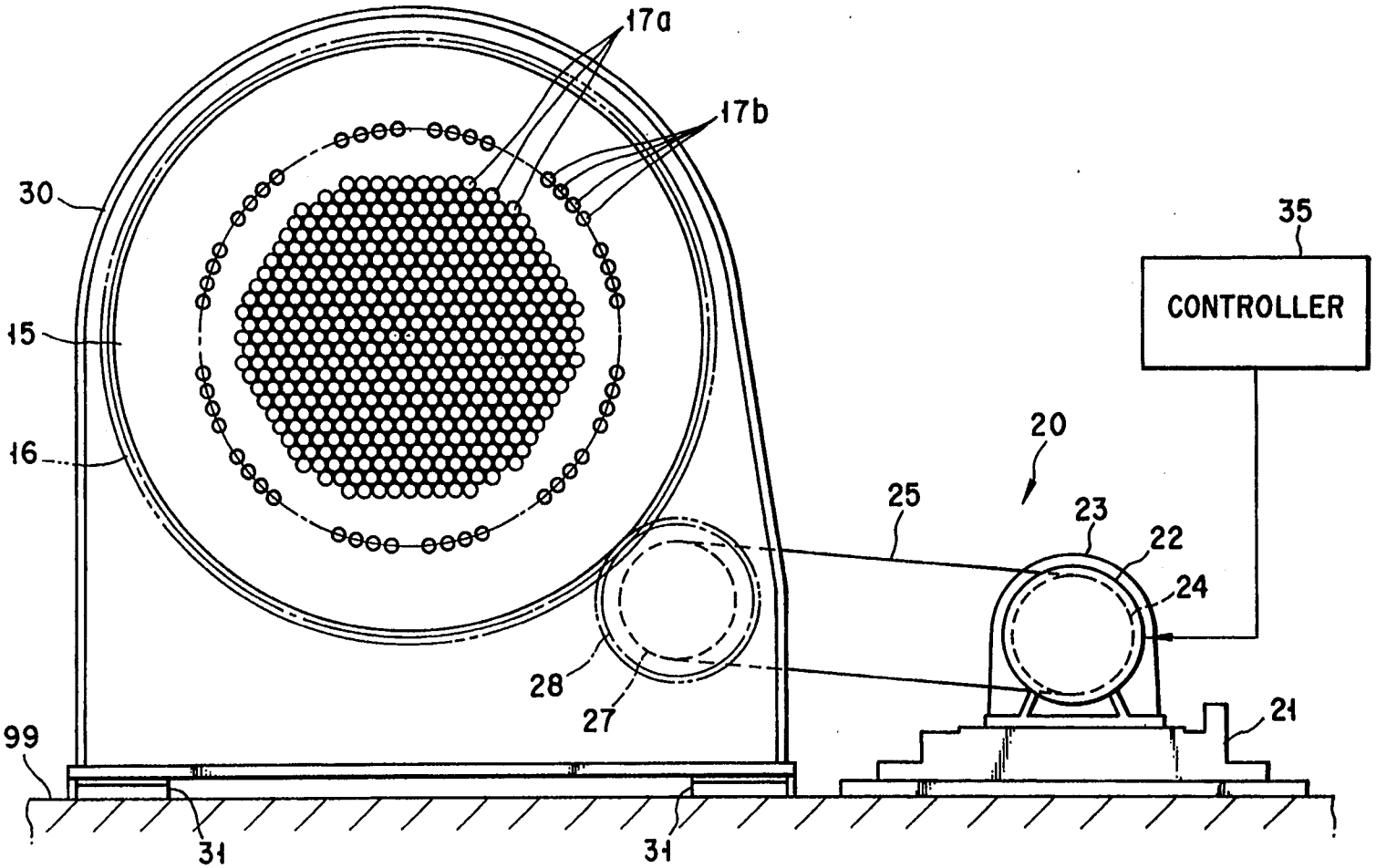
FIG. 4 is a front elevation of a rotary support mechanism of a panel plate, as viewed from a wire-feed direction.

As is shown in FIGS. 3 and 4, each rotary mechanism 20 has a cycloidal decelerator 23 and the bearing case 30 located with a constant level on a floor 99. Each bearing case 30 is supported by a plurality of bases 31 having an anti-vibration function. Each cycloidal decelerator 23 is secured to a base 21, and has an input gear engaged with the driving-shaft gear of a motor 22. The motor is controlled by a controller 35. The output gear of the decelerator 23 is coupled with a sprocket 24. Each bearing case 30 houses a gear 28 and a sprocket 27 arranged coaxial with the gear 28. The gear 28 is engaged with a gear 16 on the side of the panel plate 15. A chain 25 connects the sprocket 24 to the sprocket 27. The gear 16 is coaxial with the panel plate 15, and is supported by a shaft (not shown). Each panel plate 15 is supported by a plurality of bearings (not shown), and has a diameter of 800±50 mm and a thickness of 25±10 mm.

Figure 5:
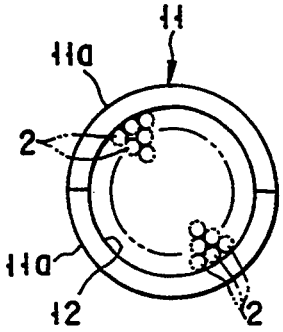
FIG. 5 is a front elevation, showing a fixed closing die.

As is shown in FIG. 5, the first closing die (fixed closing die) 11 has a casing (not shown), and two semi-circular ring members 11a are housed in the casing. 421 wires are inserted in the closing inlet 12 of the first 10 closing die 11 in a tight manner. The casing of the first closing die 11 is fixed to a frame (not shown) by means of bolts (not shown).

Figure 6:
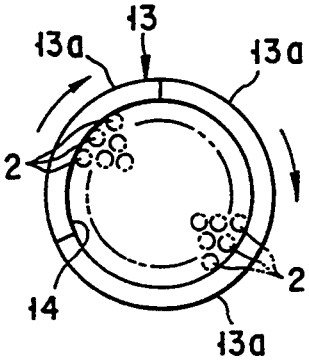
FIG. 6 is a front elevation, showing a rotary closing die.

As is shown in FIG. 6, the second closing die (rotary closing die) 13 consists of a casing (not shown) and three arc ring members 12*a* received in the casing. The closing inlet 14 of the second closing die 13 is a little larger than the inlet 12 of the first closing die 11. The second closing die 13 is rotatably supported by a rotary mechanism (not shown). This rotary mechanism is substantially identical to the rotary mechanism 20 of the panel plate 15, but is controlled by the controller 35 to rotate through 180 degrees while the panel plate 15 rotates through 360 degrees.

Figure 7:
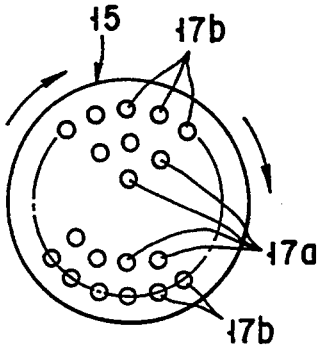
FIG. 7 is a front elevation of the panel plate.

As is shown in FIGS. 4 and 7, the panel plate 15 is shaped like a disk, and has 421 guide holes 17*a* and 17*b*. One wire 2 is inserted in each guide hole 17*a* or 17*b*.

The cable-manufacturing method of the first embodiment will be explained in detail with reference to FIGS. 8–12.

As is shown in FIG. 9, wires 2 are inserted one by one into the guide holes 17*a* and 17*b* of the panel plate 15 from the outlet side of the first closing die 11 by the use of the wire feed mechanism 5 (step S1). Plural wire holders 7 such as bobbins or T carriers are attached to the wire feed mechanism 5, and wires 2 are pulled one by one with the use of the pinch rolls 66 while the wire holders 7 are moved on the endless track 6, and are successively guided by means of the guide rolls 67 toward the guide holes 17*a* and 17*b* of the plate 15. At this time, the ring members 11*a* and 13*a* are loosened, and hence the diameters of the first and second closing dies 11 and 13 are widened. As a result, the wire 2 can easily be inserted into the dies 11 and 13.

Subsequently, the wire 2 is inserted into the guide holes 17*a* and 17*b* of the panel plate 15 located remotest to the closing dies 11 and 13. The wires 2 are set parallel to one another in the wire stranding mechanism 10. A guide tube is provided between each adjacent pair of the panel plates 15 for guiding the wires 2. The time period required to insert 421 wires into the guide holes 17*a* and 17*b* of all the panel plates 15 is about four hundreds minutes.

After insertion of the wires 2 into the guide holes 17*a* and 17*b* of all the panel plates 15, the wires 2 are cut between the first closing die 11 and the pinch rolls 66 located closest to the die 11. Then, the tip ends of the wires 2 projecting from the inlet 12 of the die 11 is fastened by means of a socket (not shown). In this state, the wires 2 are pulled along the pass-line PL and wound on the reel 8 by means of a jack (not shown), while the second closing die 13 and all the panels 15 are rotated in the same direction (step S2). At this time, setting of the wirers 2 has been completed, where 10 the length of each wire 2 is 500 m or more.

After setting of the wires 2, all the wires 2 are simultaneously pulled along the pass-line PL by means of a pulling device 9 and the reel 8 (step S3). The pulling device 9 has a plurality of hydraulic chucks (not shown) which performs pulling operation.

In synchronism with the start of wire pulling or immediately after that, the second closing die 13 and all the panel plates 15 are rotated at a speed of 1–10 rmp, preferably 3–6 rpm (step S4). During the rotation of the second closing die 13 and plates 15, the controller 35 controls the rotary mechanism of the die 13 and the motor 22 of the plates 15 such that the die 13 rotates through 180 degrees while the plates 15 rotate through 360 degrees. Although the first closing die 11 and the panel plates 15 are indispensable elements in the invention, the second closing die 13 is dispensable. Further, although it is preferable to rotate the second closing die 13 more slowly than the panel plate 15, they may be rotated at the same speed.

The rotation of the panel plates 15 and the second closing die, and the pulling of the wires enable the wires 2 to be stranded with a large pitch, for example, of about 7.6 m. In this case, the outermost wires 2 have a strand angle falling within a range of 3–4 degrees.

During stranding, each wire 2 is loaded with a strand torque. The strand torque T and stress $\tau$ of each wire 2 has the relationship given by $$T=\{(\pi d^3)/16\}\cdot\tau \quad (1)$$

Where the wire 2 has a diameter of 7 mm, the torque exerted on the wire to plastically deform the same, i.e., a torsional yielding torque T, is 370 kgf·cm from the above equation.

After the rear ends of the wires 2 pass the second closing die 13 and the panel plate 15 closest to the die 13, the die 13 and all the plates 15 stop rotating (step S6). Then, the cable 3 thus produced is wound up onto the reel 8, and a new reel is prepared (step S7). The next cable 3 is produced by inserting the next wires into the guide holes 17*a* and 17*b* of the panel plates 15 (step S8) and then repeating the above-described steps 2–7.

Then, the wire-pulling force and torque properties obtained at the time of stranding will be explained with reference to FIGS. 13 and 14.

Figure 13:
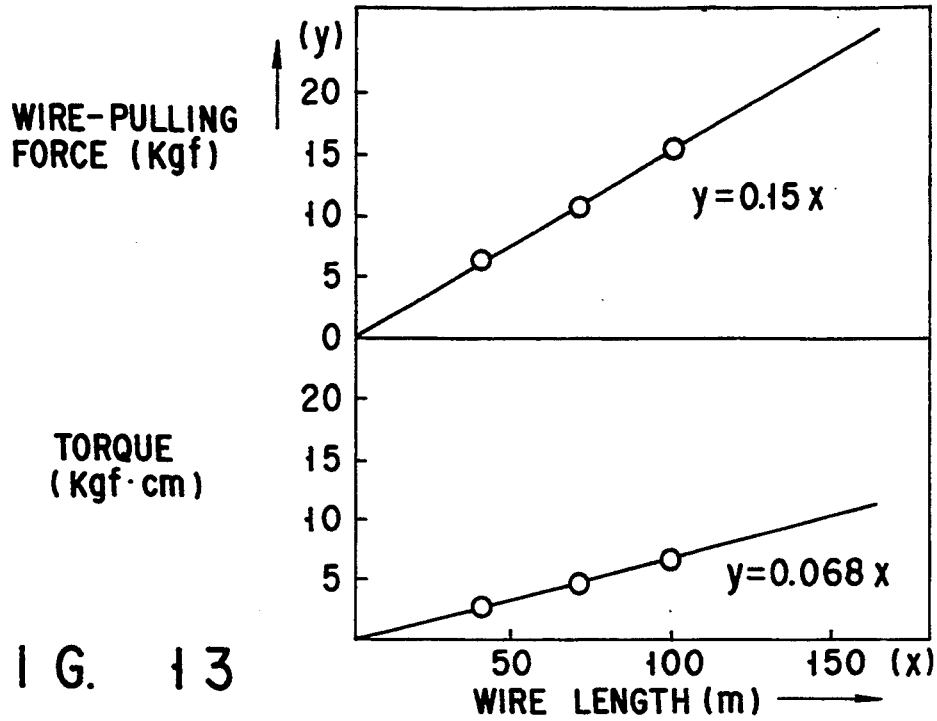
FIG. 13 is a graph, showing characteristics of a wire-pulling force and a torque obtained with the use of the conventional apparatus having only a linear line.
Figure 14:
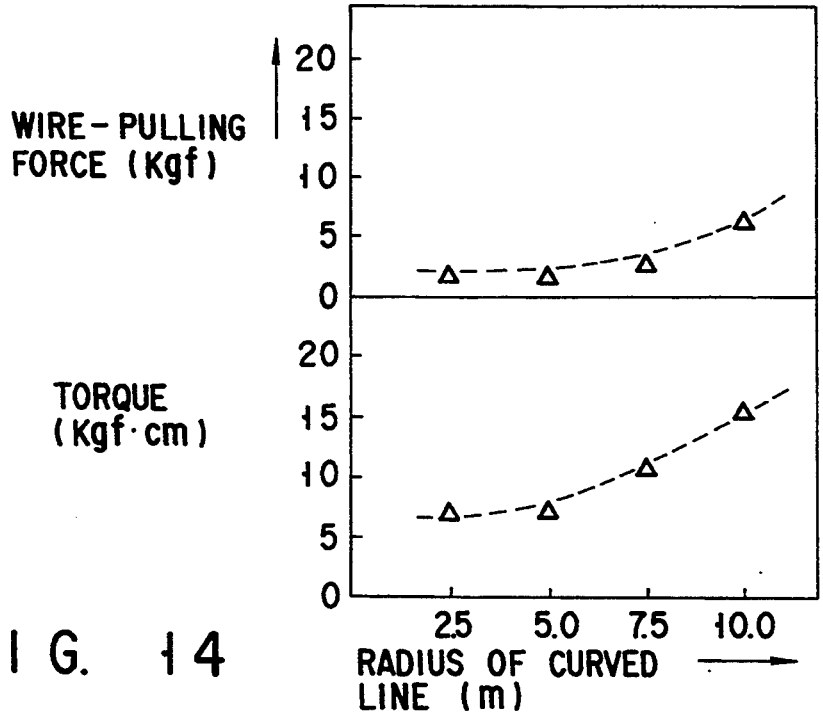
FIG. 14 is a graph, showing characteristics of a wire-pulling force and a torque obtained with the use of the apparatus of the embodiment having a curved line.

FIG. 13 shows the wire-pulling force and torque properties obtained when a linear process line is employed (a comparative case), whereas FIG. 14 shows those obtained when a process line having a curved zone is employed (the embodiment). As is evident from these figures, when the wires have the same length, the wire-pulling force and torque are larger in a curved zone than in a linear zone. Where the overall length of the wire is 400 m, the linear zone has a length of 370 m, and the curved zone has a length of 30 m, the wire-pulling force F is 58 kgf from the following equation (2) and the torque Q is 33.2 kgf·cm from the following equation (3):

$$F=(0.15\times 370)+2.5=58.0\ (kgf) \quad (2)$$

$$Q=(0.068\times 370)+8.0=33.2\ (kgf\cdot cm) \quad (3)$$

As is aforementioned, the torsional yielding torque T of the wire 2 is 370 kgf·, which is greatly smaller than the torque Q exerted on the wire 2 in the embodiment.

Since in the embodiment the torque exerted on each wire is smaller than a value which causes the wire 2 to be plastically deformed, the wire is only elastically deformed even when it is stranded between the first closing die 11 and the panel plate 15 closest thereto. The strand torque applied to the portion of the wire 2 between the die 11 and the plate 15 is elastically transferred toward a rear end portion of the wire, so that the wire 2 is elastically stranded about its axis without being plastically deformed.

Figure 10:
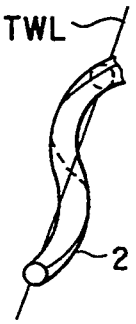
PRIOR ART FIG. 10
FIG. 10 is a perspective view, showing a wire stranded by the use of the conventional cable manufacturing method.
Figure 11:
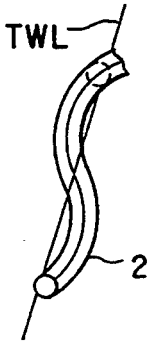
FIG. 11 is a perspective view, showing a wire stranded by the use of the cable manufacturing method according to the present invention.

In the conventional case, the wire 2 is stranded with a sharp angle and hence can be plastically deformed, as is shown in FIG. 10. On the other hand, in the wire stranding performed by the use of the method of the invention, the overall wire 2 is loosely stranded without being plastically deformed, as is shown in FIG. 11. In this case, one circumferential surface faces a line TWL every one pitch, and in other words, one circumferential surface and the other circumferential surface alternately face the line TWL every ½ pitch. Thus, the cable 3 produced by the use of the method of the invention has mechanical properties substantially identical to the conventional parallel cable (PWS). In addition, since the overall cable 3 is stranded with a large pitch, it can easily be wound onto the reel 8 without being .greatly deformed.

Figure 12:
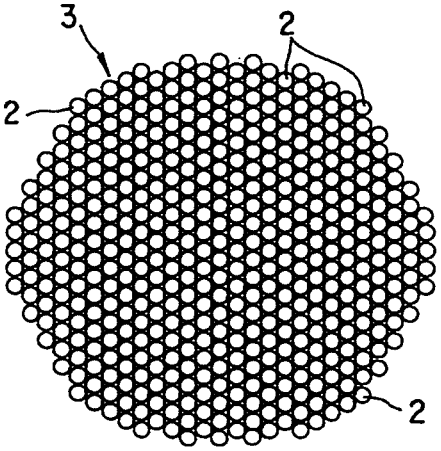
FIG. 12 is a cross sectional view of a cable manufactured by means of the method according to the present invention.
Figure 8:
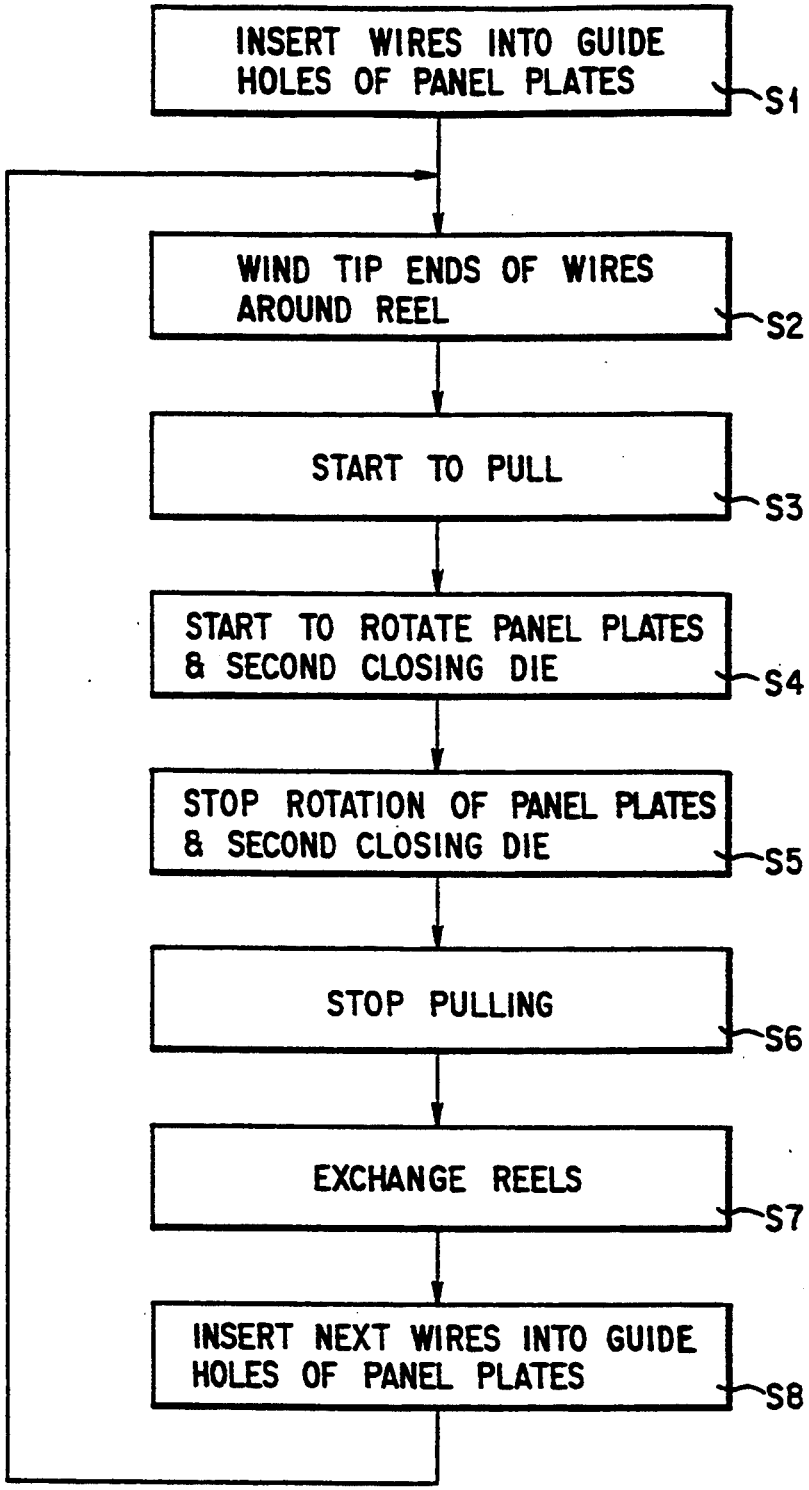
FIG. 8 is a flowchart, useful in explaining the cable manufacturing method according to the first embodiment.

As is shown in FIG. 12, the cable 3 consists of 421 wires stranded, and has a maximum outer diameter of 154 mm.

Since in the above embodiment, the pass-line for wires is sharply turned like the character U, the length of a facility required to produce the cable 3 can be as short as about 60% of the conventionally required length, which means that the plant site can be more effectively utilized.

Moreover, since the above embodiment employs the wire feed mechanism 5 in the vicinity of the first closing die 11, the wire 2 can be always efficiently set by the feed mechanism 5 without changing the wire feeding position, even when the pass-line length set for the wire 2 is changed.

The method of the invention is advantageous to be applied, in particular, to production of cables used as stays for a cable-stayed bridge, which include different kinds of cables of different lengths.

Further, a resin tape may be coated on the outer periphery of the cable 3.

Figure 15:
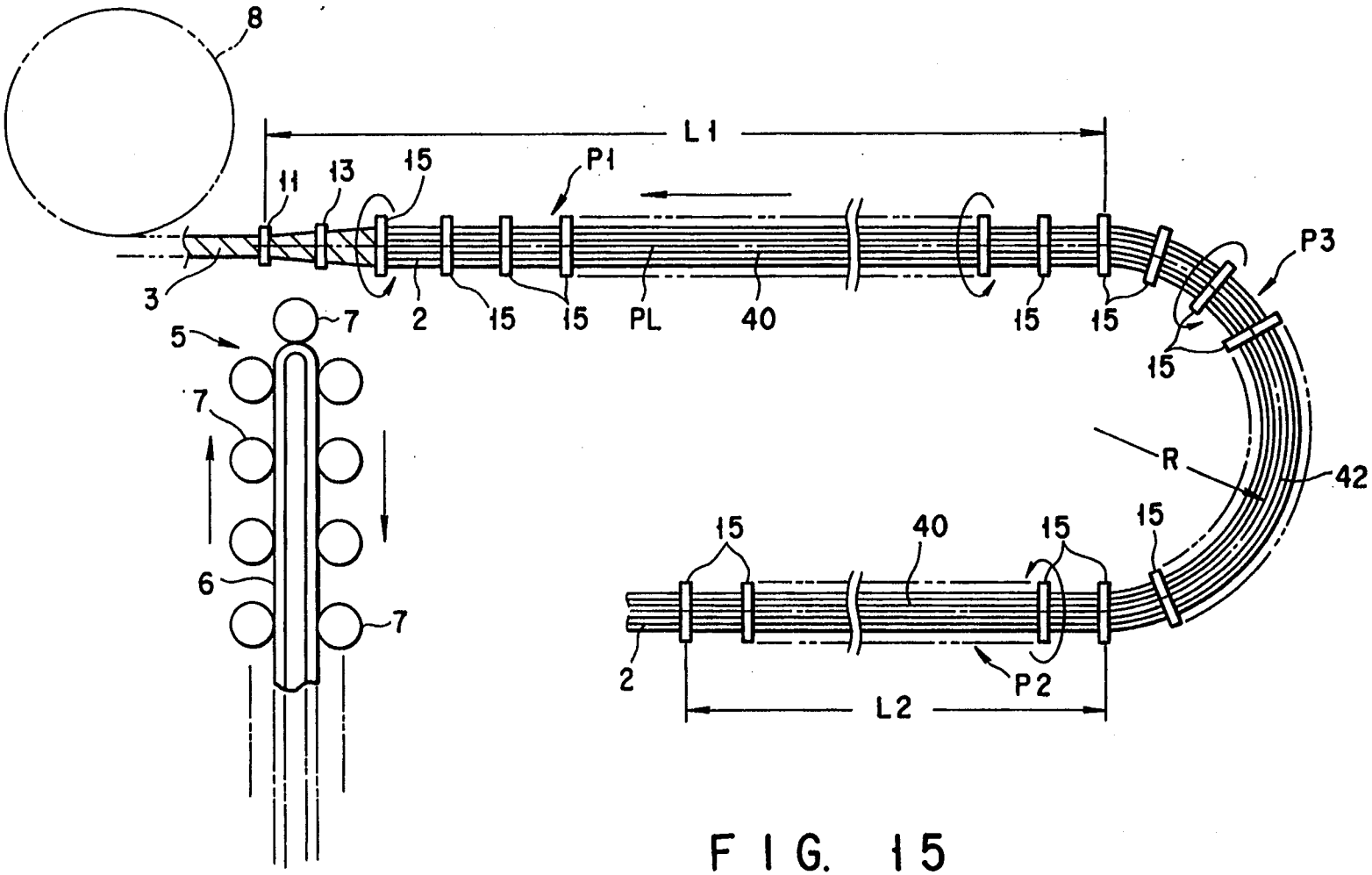
FIG. 15 is a schematic plan view, showing an apparatus which executes a cable manufacturing method according to a second embodiment of the present invention.

The second embodiment of the invention will now be explained with reference to FIGS. 15–17.

Figure 16:
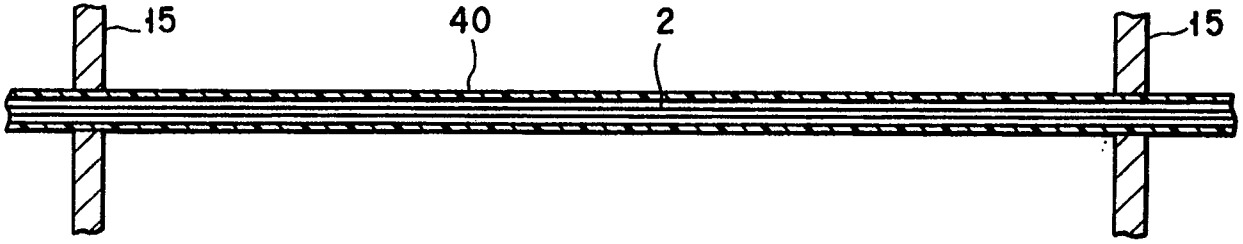
FIG. 16 is a longitudinal sectional view of a guide pipe provided in a linear zone of a pass-line.

In the pass-line PL between the linear zones P1 and P2 in the second embodiment, 421 guide pipes 40 extend through each panel plate 15, as is shown in FIG. 16. The guide pipe 40 consists of a linear pipe of a synthetic resin, and is provided for guiding the wires 2. The guide pipe 40 may be made of a metal.

Figure 17:
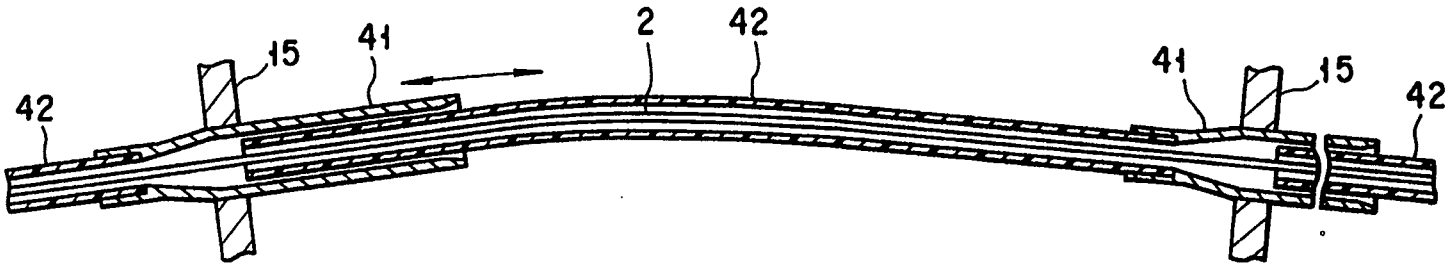
FIG. 17 is a longitudinal sectional view of a guide pipe provided in a curved zone of a pass-line.

As is shown in FIG. 17, in the curved zone P3 of the pass-line PL, 421 relay pipes 41 extend through each panel plate 15. The pipe 41 is made of a metal such as carbon steel, stainless steel, or an aluminum alloy, and is fixed to the panel plate 15. A guide pipe 42 connects each adjacent pair of relay pipes 41. One end of the guide pipe 42 is fixed to a small-diameter portion of the relay pipe 41, and the other end is loosely inserted in a large-diameter portion of the pipe 41 such that it can move therein. The guide pipe 42 is made of a wear-resistible and flexible synthetic resin such as super high-polymer polyethylene. The large-diameter portion of the relay pipe 41 has an inner diameter of 16 mm, an outer diameter of 20 mm, and a length of 250 mm, while the guide pipe 42 has an inner diameter of 11 mm, an outer diameter of 15 mm, and a length of 1050 mm.

In the second embodiment, the distance between each adjacent pair of panel plates 15 on the radially inner side varies in accordance with rotation of the panel plates 15 in the curved zone P3 (the same can be said of the distance between the same plates 15 on the radially outer side). As a result, the guide pipe 42 slides in the relay pipe 41. This prevents the rotation of each panel plate 15 from being interfered by a corresponding guide pipe 42.

Further, each wire 2 is guided by corresponding guide pipes 40 and 42, which prevents the wire from slacking or contacting adjacent wires to each other. Thus, there is no possibility of tangling of wires 2, resulting in smooth wire feeding.

Figure 18:
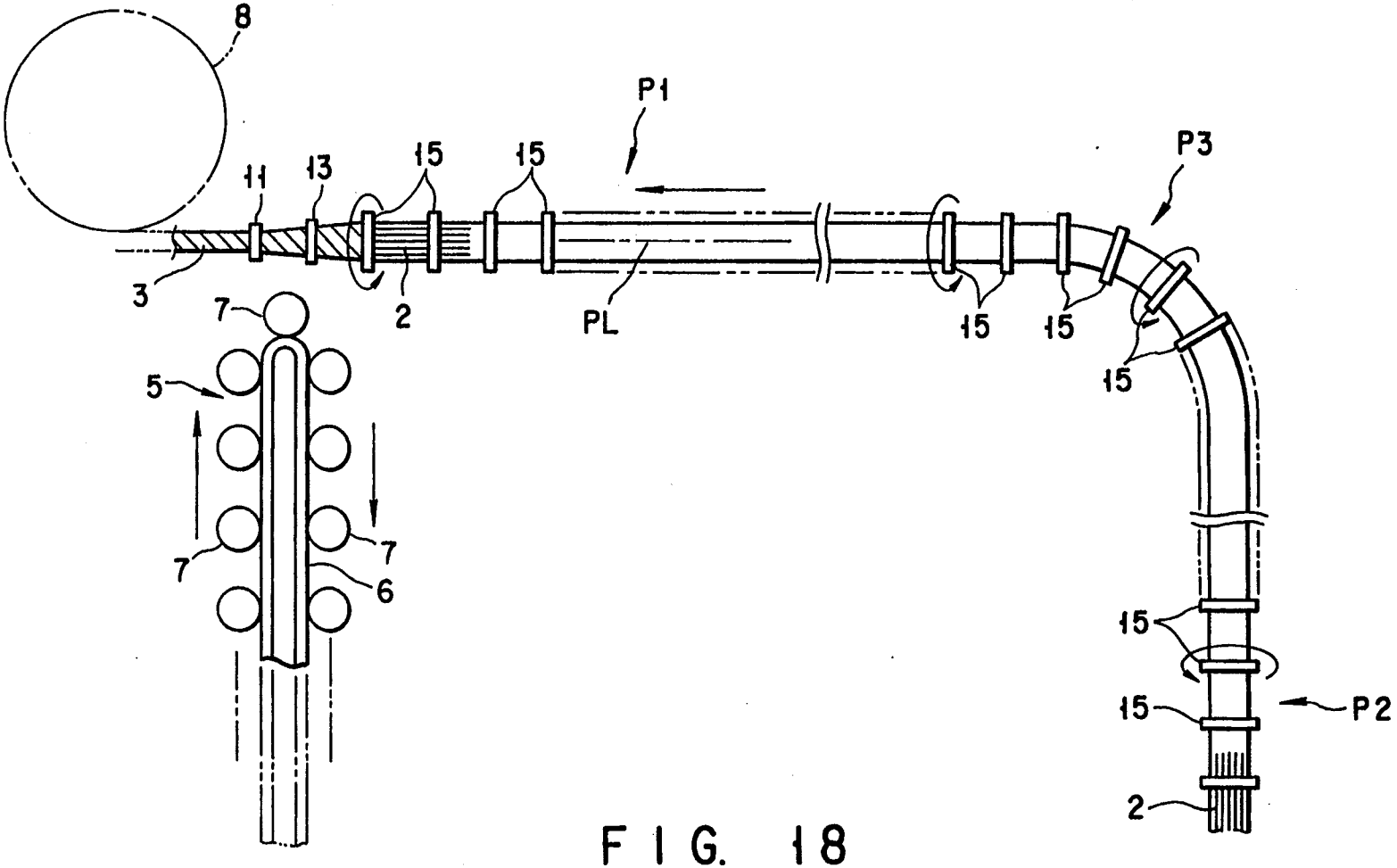
FIG. 18 is a schematic plan view, showing an apparatus which executes a cable manufacturing method according to a third embodiment of the present invention.

As is shown in FIG. 18, the curved zone P3 may be interposed between the first and second linear zones P1 and P2 such that the first and second linear zones P1 and P2 intersect each other. In this structure, too, a facility for producing a cable can be made shorter than the cable, and therefore the overall site of a manufacturing plant be effectively used.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of manufacturing a long cable comprising a plurality of stranded wires without plastically deforming the wires, comprising the steps of:

arranging a plurality of spaced apart panel plates on a pass-line along which said wires are pulled, said pass-line having a curved zone, a first linear zone located on a downstream side of said curved zone with respect to a direction of pulling of said wires, and a second linear zone located on an upstream side of said curved zone with respect to said direction of pulling, said first and second linear zones being connected to respective opposite ends of said curved zone;

arranging a closing die at a downstream end portion of said first linear zone;

interposing a plurality of first guide pipes between each adjacent pair of said spaced apart panel plates in said first and second linear zones;

inserting a plurality of relay pipes through each panel plate in said curved zone, said relay pipes each having a small-diameter portion and a large-diameter portion which is larger in diameter than said small-diameter portion;

interposing a second guide pipe between each adjacent pair of said relay pipes in a longitudinal direction of said pass-line in said curved zone, such that one end of each said second guide pipe is coupled to a small-diameter portion of one of said pair of said relay pipes, and another end of each said second guide pipe is loosely inserted in a large-diameter portion of the other of said pair of said relay pipes;

inserting all wires from a downstream side of said pass-line to an upstream side of said pass-line, said wires being first inserted through said closing die, then through said first guide pipes of said first linear zone, then through said second guide pipes and said relay pipes, and then through said first guide pipes of said second linear zone, such that the wires are arranged substantially parallel with one another; and pulling the wires through said closing die, said first and second guide pipes and said relay pipes, while rotating said panel plates in a same direction without twisting the wires, thereby stranding the wires with a large pitch so as not to plastically deform the wires.

2. The cable manufacturing method according to claim 1, further comprising the step of providing a wire feed mechanism in the vicinity of the closing die for feeding the wires from the closing die to the panel plates to set the wires on the pass-line.

3. The cable manufacturing method according to claim 1, further comprising the step of providing a rotary closing die between the closing die and one of the panel plates closest to the closing die, and rotating said rotary closing die in the same direction as the panel plates, and fixing the closing die so as not to rotate.

4. The cable manufacturing method according to claim 3, wherein the rotary closing die rotates at half of the rotational speed of the panel plates.

5. The cable manufacturing method according to claim 1, wherein:

each panel plate is rotatably received in a bearing case, and each adjacent two panel plates are coupled with each other by means of a universal joint; and said step of rotating said panel plates includes transmitting a torque from one of the adjacent two panel plates to the other of the adjacent two panel plates through the universal joint.

6. The cable manufacturing method according to claim 5, wherein said step rotating said panel plates includes rotating every third panel plate in the curved zone.

7. The cable manufacturing method according to claim 1, comprising setting a radius of curvature R of said curved zone to be at least 100 times a diameter d of each wire.

8. The method according to claim 1, wherein the panel plates are rotated so as to produce a pitch of stranding of 7.6 m, and an angle of stranding of an outermost wire which falls within a range of 3° to 4°.

9. The method according to claim 1, comprising arranging said panel plates in said-curved zone such that said curved zone is curved at an angle of about 180°.

10. The method according to claim 1, comprising arranging said panel plates in said curved zone such that said curved zone is curved at an angle of about 90°.

11. A method of manufacturing a long cable comprising a plurality of stranded wires without plastically deforming the wires, comprising the steps of:

arranging a plurality of spaced apart panel plates on a pass-line along which said wires are pulled, said pass-line having a curved zone, a first linear zone located on a downstream side of said curved zone with respect to a direction of pulling of said wires, and a second linear zone located on an upstream side of said curved zone with respect to said direction of pulling, said first and second linear zones being connected to respective opposite ends of said curved zone;

arranging a closing die at a downstream end portion of said first linear zone;

inserting all wires from a downstream side of said pass-line to an upstream side of said pass-line, said wires being first inserted through said closing die, then through said first linear zone, then through said curved zone, and then through said second linear zone, such that the wires are arranged substantially parallel with one another;

pulling the wires through said closing die, said linear zones and said curved zones, while rotating said panel plates in a same direction without twisting the wires, thereby stranding the wires with a large pitch so as not to plastically deform the wires; and providing a wire feed mechanism in the vicinity of the closing die for feeding the wires from the closing die to the panel plates to set the wires on the linear and curved zones of said pass-line.

12. The cable manufacturing method according to claim 11, further comprising the step of providing a rotary closing die between the closing die and one of the panels closest to the closing die, and rotating said rotary closing die in the same direction as the panel plates, and fixing the closing die so as not to rotate.

13. The cable manufacturing method according to claim 12, wherein the rotary closing die rotates at half of the rotational speed of the panel plates.

14. A method of manufacturing a long cable comprising a plurality of stranded wires without plastically deforming the wires, comprising the steps of:

arranging a plurality of spaced apart panel plates on a pass-line along which said wires are pulled, said pass-line having a curved zone, a first linear zone located on a downstream side of said curved zone with respect to a direction of pulling of said wires, and a second linear zone located on an upstream side of said curved zone with respect to said direction of pulling, said first and second linear zones being connected to respective opposite ends of said curved zone;

arranging a closing die at a downstream end portion of said first linear zone;

inserting all wires from a downstream side of said pass-line to an upstream side of said pass-line, said wires being first inserted through said closing die, then through said first linear zone, then through said curved zone, and then through said second linear zone, such that the wires are arranged substantially parallel with one another;

pulling the wires through said closing die, said linear zones and said curved zones, while rotating said panel plates in a same direction without twisting the wires, thereby stranding the wires with a large pitch so as not to plastically deform the wires;

wherein each panel plate is rotatably received in a bearing case, and each adjacent two panel plates are coupled with each other by means of a universal joint; and said step of rotating said panel plates includes transmitting a torque from one of the adjacent two panel plates to the other of the adjacent two panel plates through the universal joint.

15. The cable manufacturing method according to claim 14, wherein said step of rotating said panel plates includes rotating every third panel plate in the curved zone.

* * * * *